US007178906B2

(12) United States Patent
Drury et al.

(10) Patent No.: US 7,178,906 B2
(45) Date of Patent: Feb. 20, 2007

(54) DROPLET DEPOSITION APPARATUS

(75) Inventors: Paul R. Drury, Hertfordshire (GB); Stephen Temple, Cambridge (GB)

(73) Assignee: Xaar Technology Limited, Cambridge (GB)

( * ) Notice: Subject to any disclaimer, the term of this patent is extended or adjusted under 35 U.S.C. 154(b) by 20 days.

(21) Appl. No.: 10/381,606

(22) PCT Filed: Sep. 26, 2001

(86) PCT No.: PCT/GB01/04293

§ 371 (c)(1),
(2), (4) Date: Oct. 14, 2003

(87) PCT Pub. No.: WO02/26501

PCT Pub. Date: Apr. 4, 2002

(65) Prior Publication Data

US 2004/0113992 A1 Jun. 17, 2004

(30) Foreign Application Priority Data

Sep. 26, 2000 (GB) ..... 0023544.0
Jul. 16, 2001 (GB) ..... 0117295.6

(51) Int. Cl.
*B41J 2/045* (2006.01)

(52) U.S. Cl. ..... 347/68; 347/69

(58) Field of Classification Search ..... 347/68–72, 347/58–59, 20, 40–44
See application file for complete search history.

(56) References Cited

U.S. PATENT DOCUMENTS 5,463,414 A * 10/1995 Temple et al. ..... 347/68
5,598,196 A * 1/1997 Braun ..... 347/68
5,818,483 A 10/1998 Mizutani ..... 347/72
6,095,641 A 8/2000 Kishi ..... 347/71

FOREIGN PATENT DOCUMENTS

| | | | |
|---|---|---|---|
| EP | 277 703 | A1 | 8/1988 |
| EP | 278 590 | A1 | 8/1988 |
| EP | 589 941 | B1 | 4/1994 |
| EP | 734 865 | A2 | 10/1996 |
| EP | 1 029 678 | A2 | 8/2000 |
| JP | 09-207331 | | 8/1997 |
| JP | 11-115195 | | 4/1999 |
| JP | 11151814 | A * | 6/1999 |
| WO | WO 97/39897 | | 10/1997 |
| WO | WO 00/29217 | | 5/2000 |

* cited by examiner

*Primary Examiner*—Hai Pham
(74) *Attorney, Agent, or Firm*—Marshall, Gerstein & Borun LLP

(57) ABSTRACT

An injet printhead is formed by a multistage process: grooves are formed on the base of a block of piezoelectronic material, and a conductor is applied thereto. Conducting tracks are deposited on a substrate with matching spacing, such that the base and piezoelectric material can be joined giving a desired electrical connection. Channels are cut into the top of the piezoelectric block to intersect with the grooves, forming ink chambers, and these are provided with electrodes in electrical contact with the tracks. Cover plates are added to the assembly to provide a manifold and nozzles.

31 Claims, 13 Drawing Sheets

DROPLET DEPOSITION APPARATUS

This is the U.S. national phase of International Application No. PCT/GB01/04293 filed Sep. 26, 2001, the entire disclosure of which is incorporated herein by reference.

This invention relates to droplet deposition apparatus, in particular inkjet printheads including methods of manufacturing and components for use in droplet deposition apparatus.

In European Patent Number 0 277 703 and European Patent Number 0 278 590, multi-channel array droplet deposition apparatuses are disclosed, suitable for use as drop-on-demand inkjet printheads. The multi-channel arrays comprise a base sheet of piezoelectric material, poled normal to the sheet, with an array of parallel grooves in the sheet, forming open-topped channels with walls between them, opposite walls of the channels carrying electrodes. Application of electrical pulses to the electrodes on either side of a wall to generate an actuating field normal to the poling direction causes that wall to deflect in the direction of the field, thus changing the pressure in any ink in the adjacent channels.

In European patent Number 0 589 941, a multi-channel array is disclosed in which a closure sheet carries an array of parallel conductive tracks at the same spacing as the channel spacing, the tracks being bonded mechanically and electrically, e.g. by solder, to the electrodes on either side of the channels. Such an arrangement requires a pre-patterning system for the closure sheet which can cope with the three dimensional piezoelectric structure.

The closure sheet must be relatively simple to ensure accurate registration, good track definition and adhesion to the actuator. Ink is supplied from the rear of the channels through a manifold component. More recent ink jet constructions, such as in WO 97/39897 have identified the benefit of supplying ink into the channel through the top cover. The closure sheet, because it bounds the top walls of the channels, is usually of a similar material to the walls. Any large difference in the expansion coefficients of the materials may cause walls to break.

One of the many benefits of the construction in EP 0 589 941 is that the closure sheet, and associated drive circuits can be pre-tested prior to joining to the channelled component. Many of the stages of preparation of a printhead take place after the channels have been formed, and the channelled piezoelectric sheet must be handled with great care to avoid damage.

A further method of constructing a print head is shown in WO 00/29217. A piezoelectric block is mounted onto a planar substrate and channels sawn. The substrate acts both to support and strengthen the piezoelectric in use and during manufacture. Conductive tracks can be formed on the substrate prior to attaching the piezoelectric block. The application recognises the difficulty of attaching active electrodes to the pre-formed tracks and addresses the problem by forming simultaneously with the electrodes on the piezoelectric block, conductive tracks on the substrate. Difficulties sometimes arise in ensuring electrical continuity at the boundary between the piezoelectric block and the substrate.

Laser manufacturing is relatively expensive and better suited to discrete, step-by-step operations rather than to the simultaneous formation of repeating structures. Current markets today demand ever larger printheads with increased numbers of tracks per printhead This demands cost-effective and fast manufacturing steps.

It Is an object of the present invention to address this and other problems.

In one aspect of the present invention there is provided a method of forming a droplet deposition apparatus comprising the steps: forming a substrate having one or more electrically conductive tracks, attaching to said substrate a body of piezoelectric material having a top surface and a bottom surface, said bottom surface overlying said tracks and establishing electrical connection with said tracks for actuation of the piezoelectric material, and forming in said attached piezoelectric material at least one droplet ejection chamber.

Beneficially the substrate having the electrically conductive tracks can also have the drive circuits assembled to it before the piezoelectric material is attached. A protective coating can be deposited over the drive circuit, tracks, substrate and attached piezoelectric material to prevent any debris generated from subsequent processing steps from affecting the finished product A particularly preferred form of piezoelectric material is a lead zirconate titanate (PZT) and the body may be a single homogenous sheet or formed as a laminate of two thinner sheets. It is desirable that the PZT is poled prior to attaching such that when it is actuated it deforms in shear.

Preferably, electrically conductive points are provided on the bottom surface of the body of piezoelectric material to improve electrical connection thereto. It is preferred if the conductive points extend into the piezoelectric body by forming depressions by sawing or other means.

The electrically conductive points should be electrically isolated from one another by, if need be, removing conductive material that connects them. This can be achieved by any conventional process such as sawing, etching or lift-off.

In a first embodiment, the depressions are filled with a conductive material, preferably a deposited metal. This metal may be used as a solder material to both mechanically and electrically connect the piezoelectric body to the substrate. The ejection chambers, formed by removing material from the top surface of the piezoelectric body, extend into conductive material. An electrode material is applied by electroless plating, vacuum deposition or any other appropriate method to the newly formed chambers such that it contacts the conductive material in the depression. It is preferred that the ejection chambers are formed by sawing.

In a second embodiment, the depressions are coated with a conductive material, but not filled. Ejection chambers formed subsequently open into a respective depression. Electrode material is deposited as above.

In a third embodiment, the depressions are coated with a conductive material and subsequently filled with a non-conductive material. The ejection chambers formed from the top surface extend into the non-conductive material. Beneficially, the conductive material coating the depressions serves as the actuating electrodes. The non-conductive material can usefully act as a passivant to protect the conductive material from chemical attack by ink In all these embodiments, the ejection chambers can be closed by a separate cover component that can also function as a nozzle plate. The present invention is as equally applicable to roof-shooter arrangements as in WO 00/29217 or end shooter arrangements as in WO 97/39897.

The present invention will now be described, by way of example, with reference to the following drawings in which.

Figure 6A:
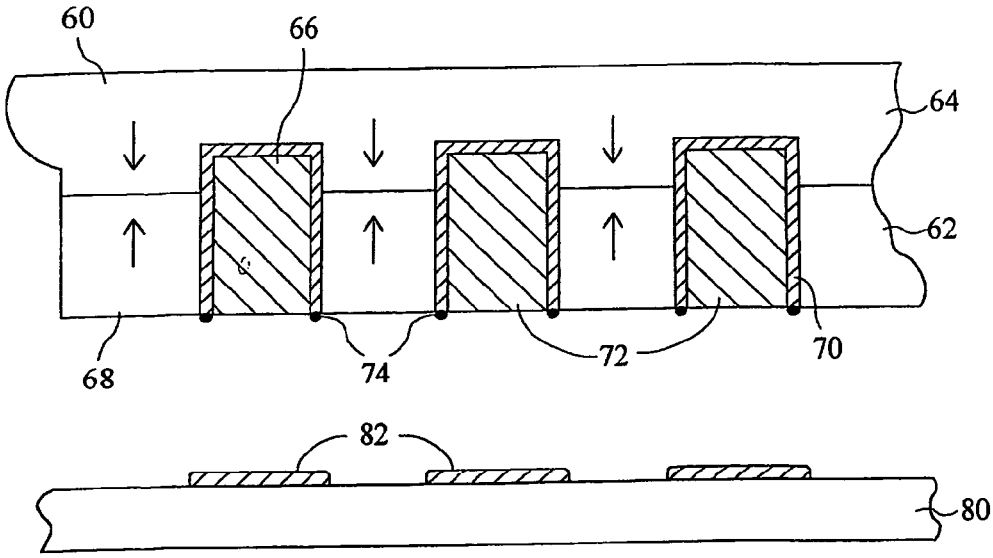
Figure 6B:
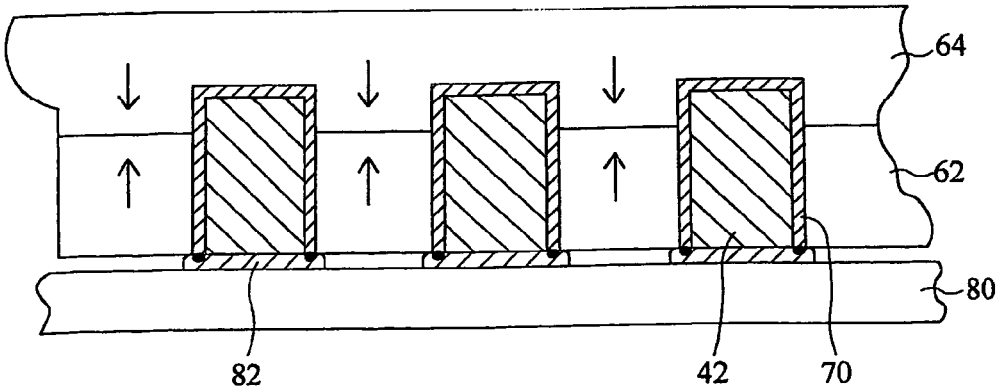
Figure 6C:
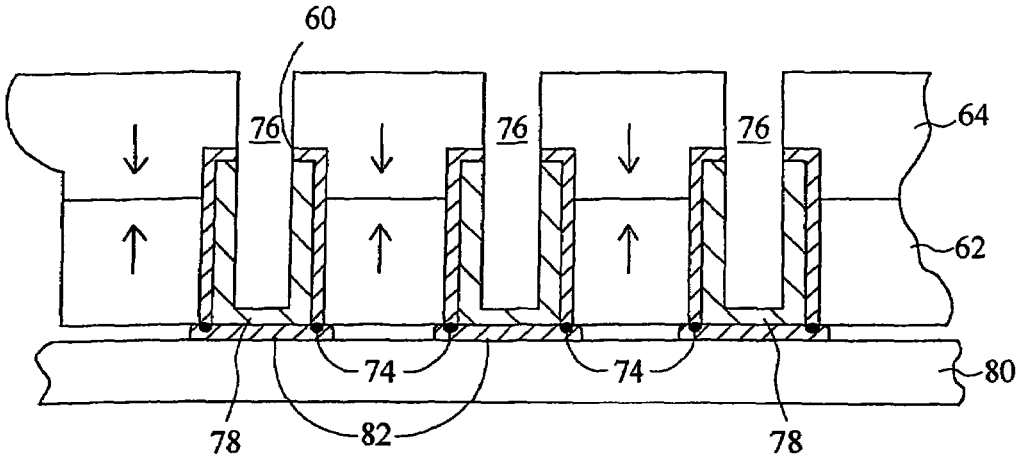
Figure 6D:
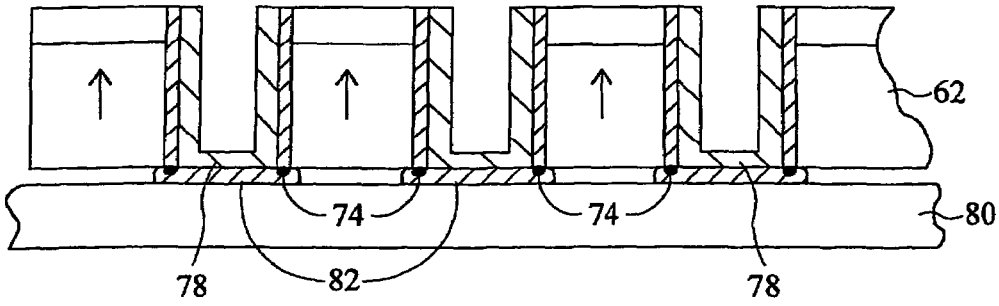
Figure 6E:
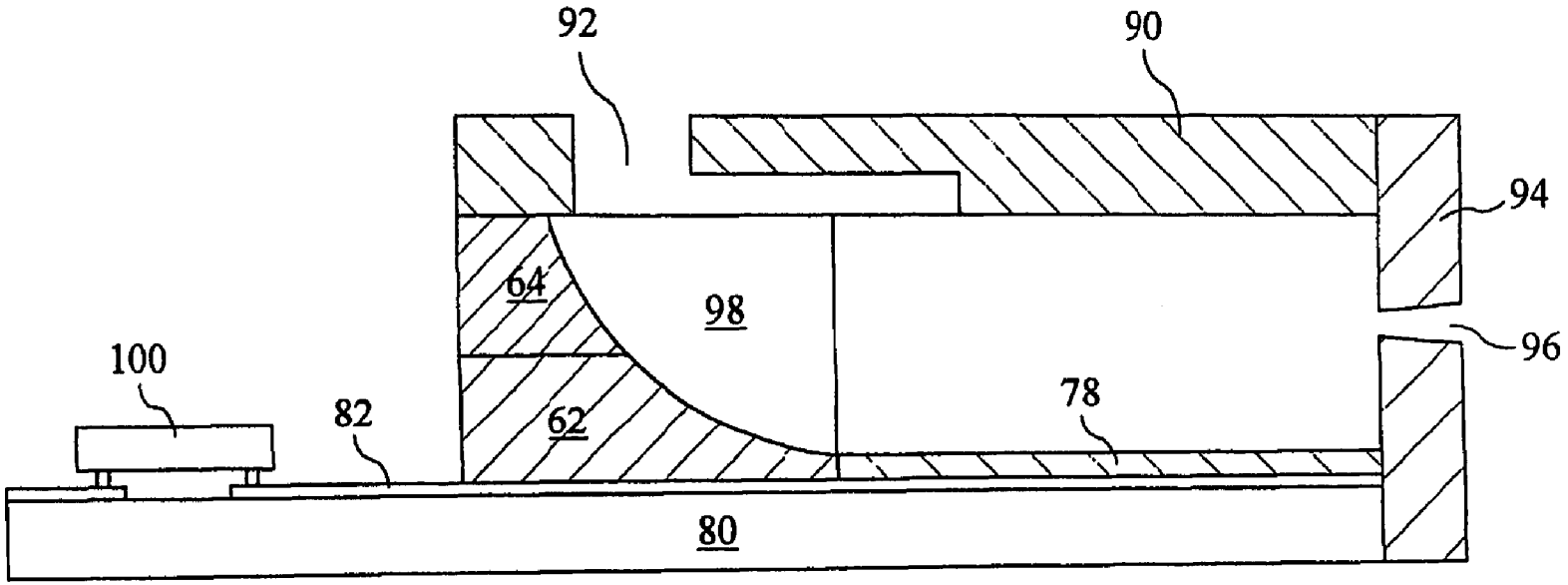
Figure 7:
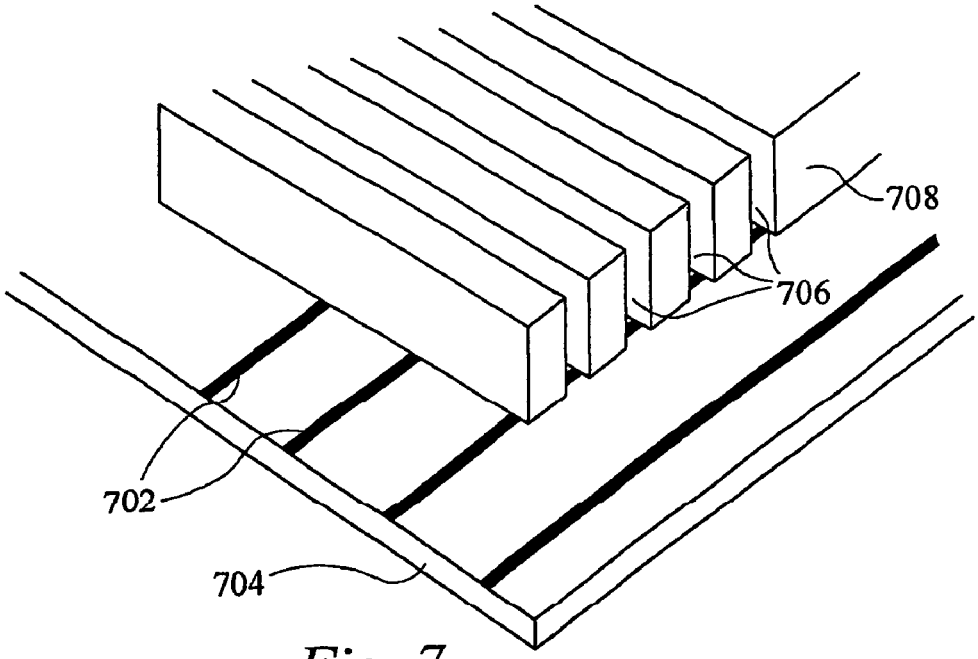
Figure 8:
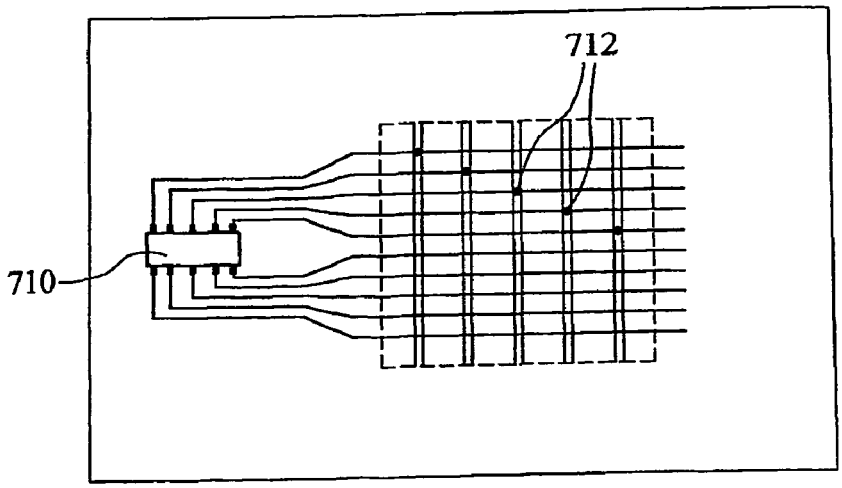

FIGS. 4(*a*) to 4(*h*) depict eight stages in the manufacture of a printhead according to a first embodiment;

FIGS. 5(*a*) to 5(*e*) depict stages in the manufacture of a printhead according to a second embodiment;

FIGS. 6(*a*) to 6(*e*) depict stages in the manufacture of a printhead according to a third embodiment; and FIGS. 7 and 8 illustrate a modified form of the invention in perspective and plan view, respectively.

Figure 1:
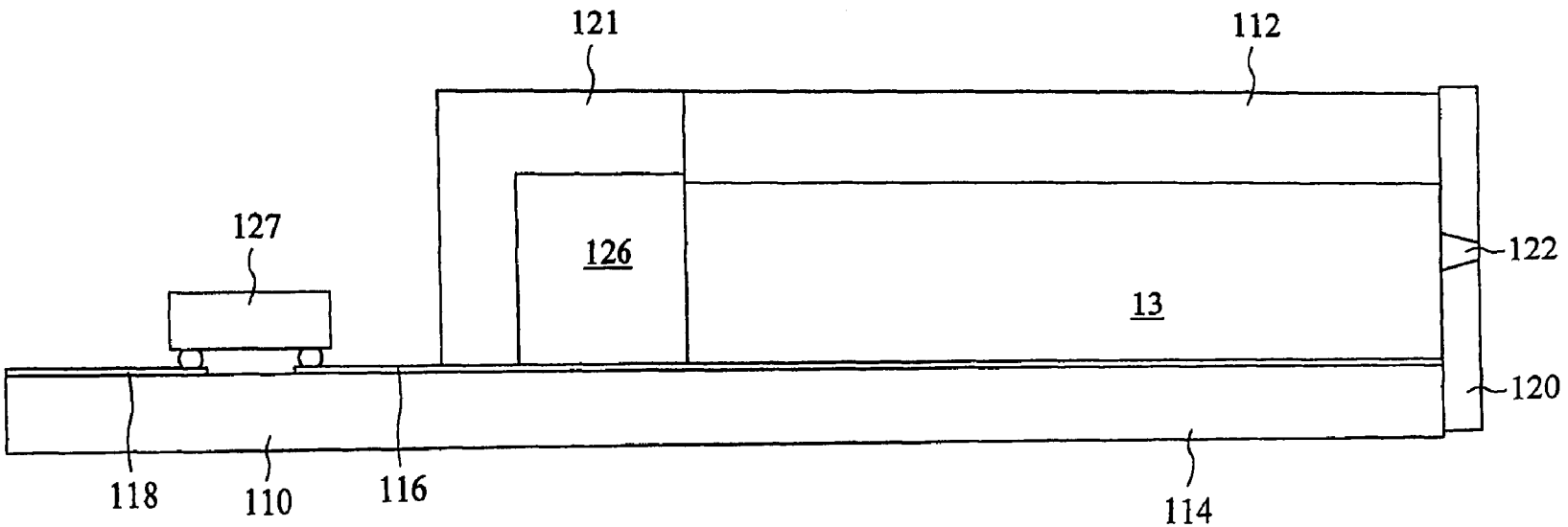
Fig. 1 Prior Art
FIG. 1 illustrates a printhead according to the prior art.
Figure 2:
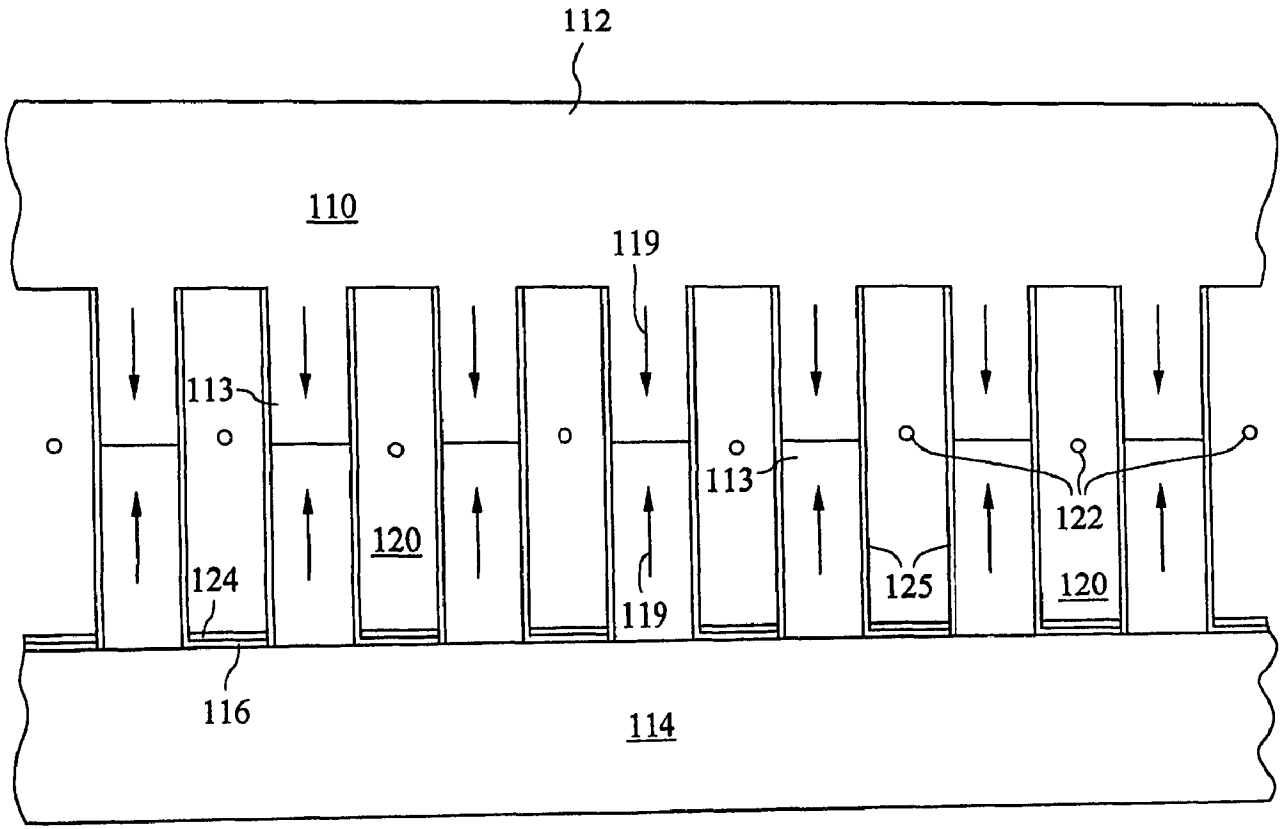
Fig. 2 Prior Art
FIG. 2 is a section in the direction X—X of FIG. 1.

The printhead 110 shown in FIGS. 1 and 2 comprises a body of PZT laminate 112 bonded to a substrate 114. Two layers of PZT are poled in opposite directions, as arrowed at 119. As shown best in FIG. 2, electrically conductive tracks 116 extend across the substrate 114 and establish connection with a drive and/or control chip 127. Further tracks 118 provide input terminals for the printhead.

Channels 120 sawn into the PZT laminate 112 before it is bonded to the substrate define actuating walls 113. Electrodes 125 deposited in the respective channels lie in electrical contact with the respective tracks 116. In one manufacturing arrangement, solder 124 provided on the tracks is heated to bond with the electrodes.

The construction is completed by a cover 121 which defines an ink manifold 126 and a nozzle plate 120 which carries ink ejection orifices 122.

As described in more detail in the published documents referred to above, the application of a firing waveform through tracks 16 to the electrode 11 in any channel 20, causes chevron-like deformation of both walls 13, through shear mode actuation of the PZT wall material. An acoustic wave travels through ink contained in the channel with a resulting ink droplet being ejected through orifice 22.

Figure 3:
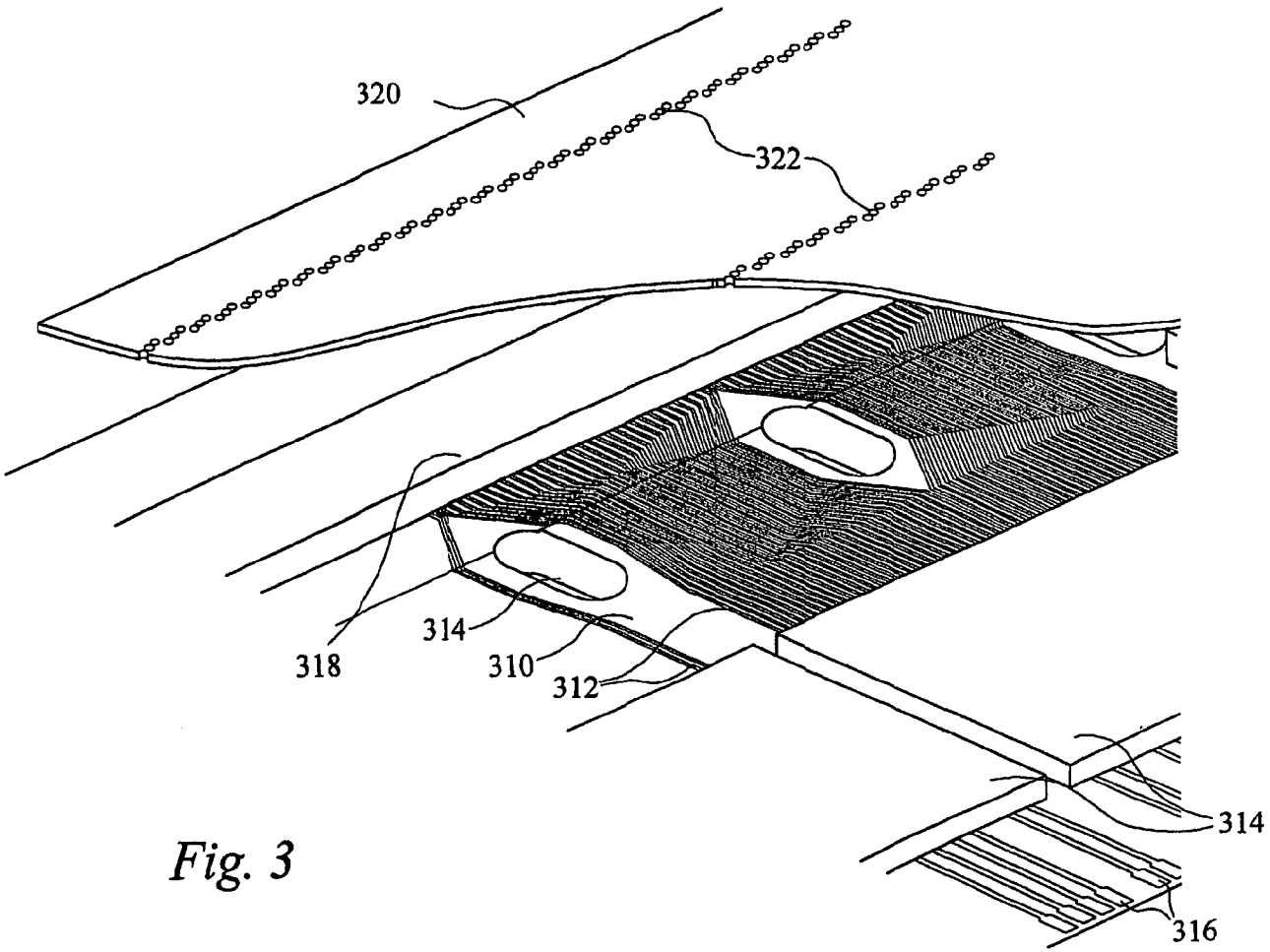
FIG. 3 is an exploded diagram illustrating the manufacture of a printhead according to the present invention.
Figure 4A:
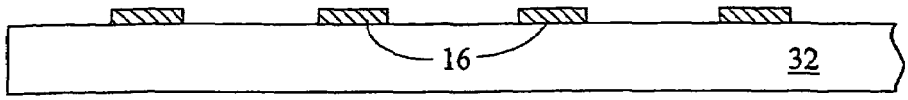
Figure 4B:
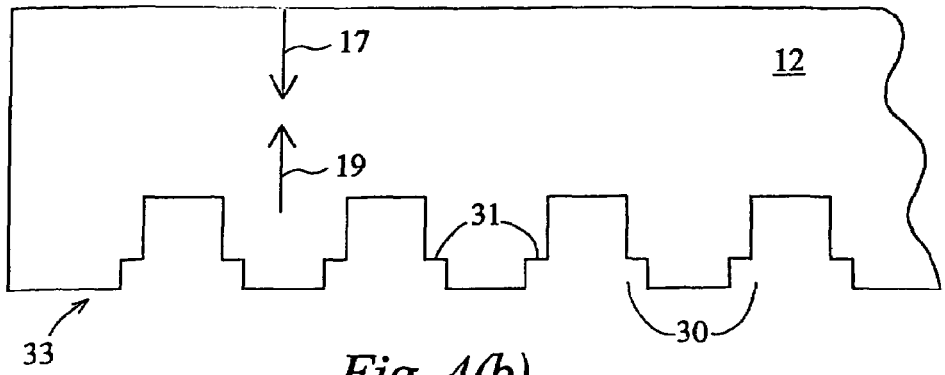
Figure 4C:
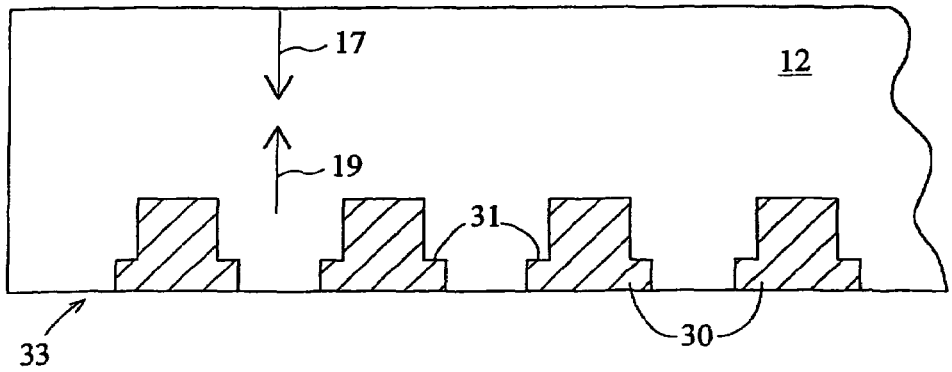
Figure 4D:
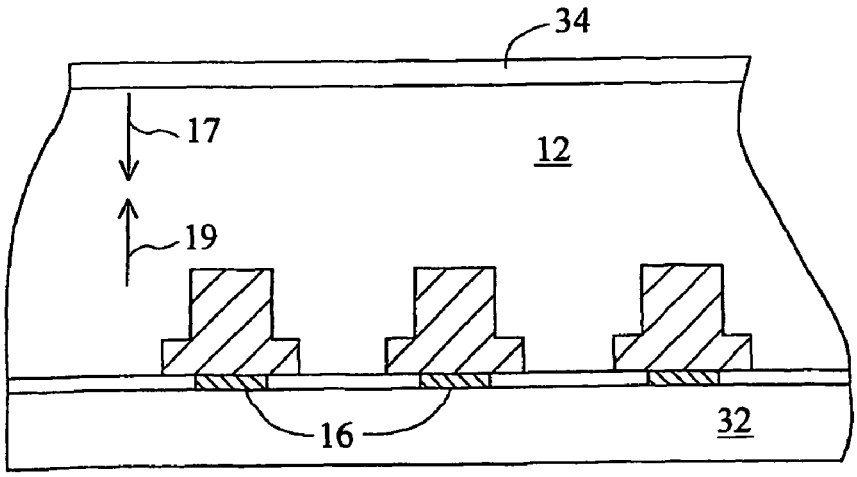
Figure 4E:
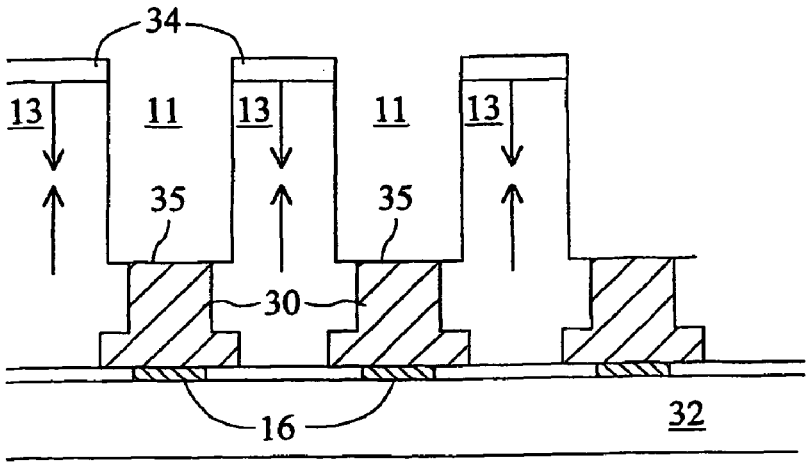
Figure 4F:
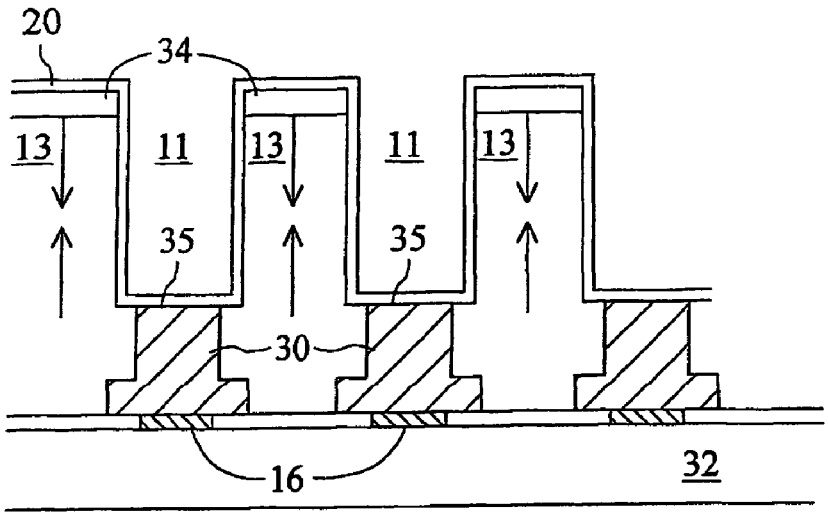
Figure 4G:
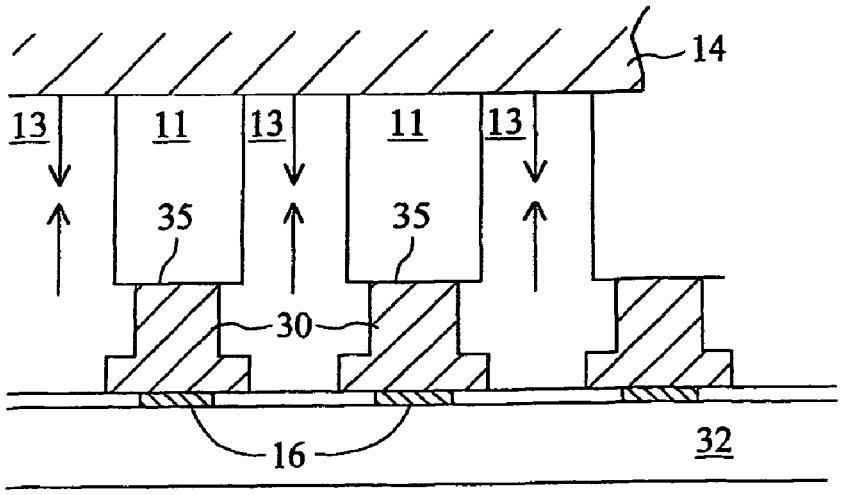
Figure 4H:
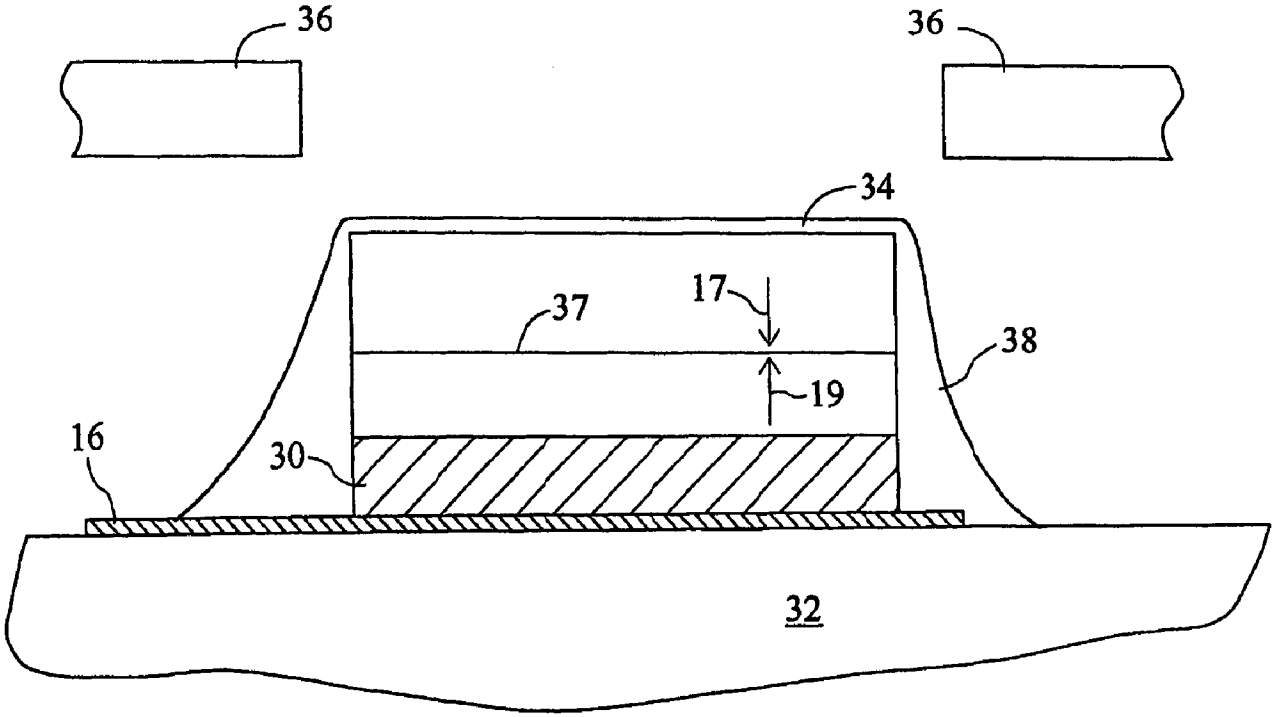
Figure 5A:
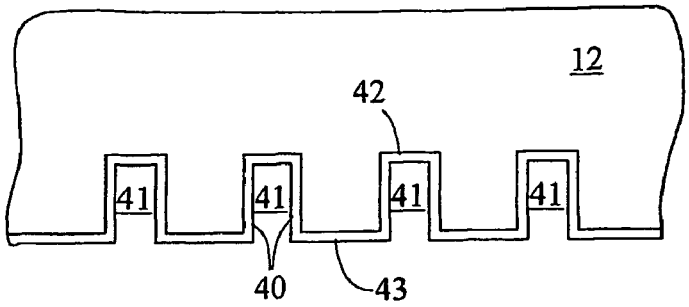
Figure 5B:
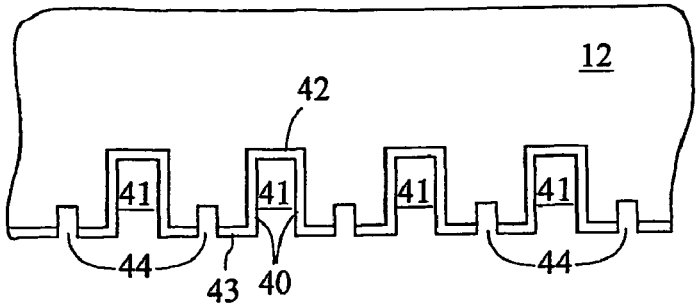
Figure 5C:
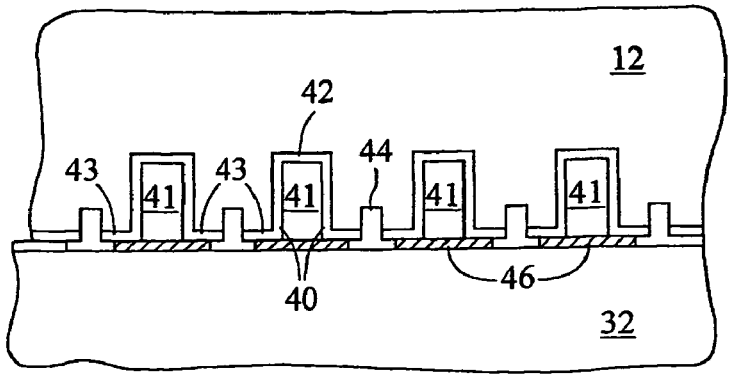
Figure 5D:
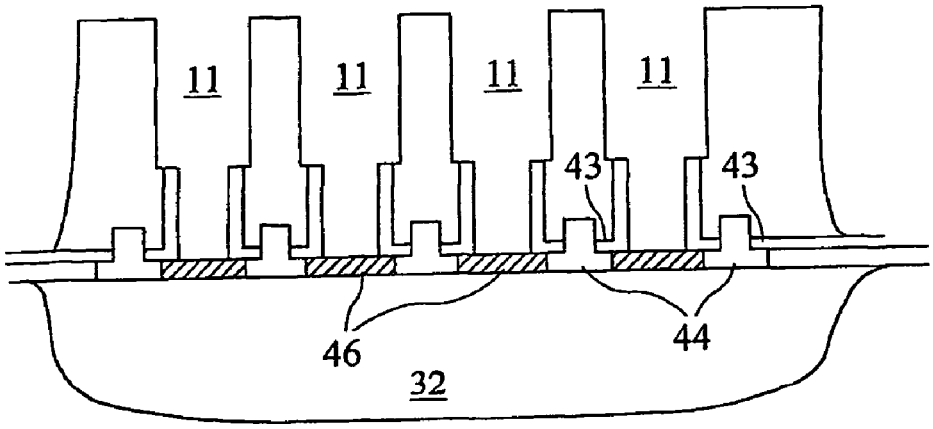
Figure 5E:
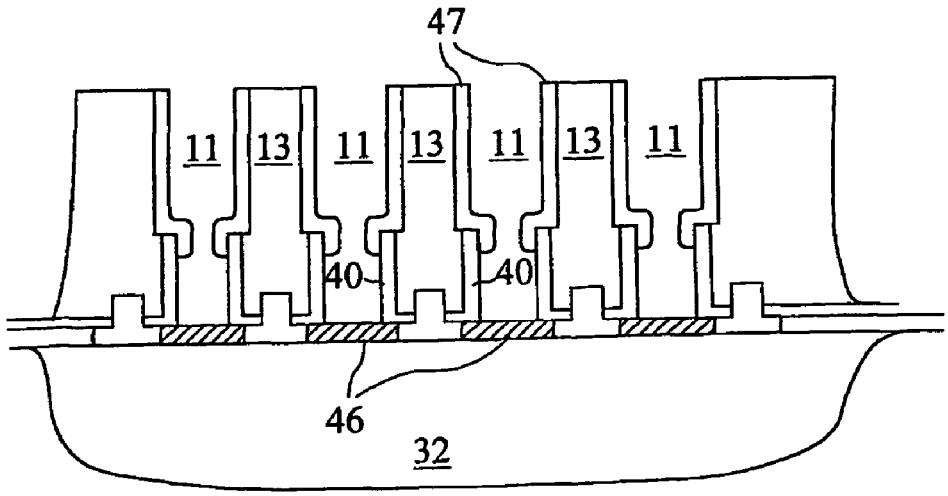

FIG. 3 illustrates by way of an exploded diagram, a printhead manufactured In accordance with the invention.

A substrate 310 is formed with an array of generally parallel conductive tracks 312 which provide connections to drive and/or control chips 314. In this particular arrangement, the tracks 312 are in places along their length, diverted to avoid ink supply apertures 314 in the substrate. Also carried on the substrate, are pads 316 providing for external connection with print data input devices.

A block of PZT material 318, as will be described in detail below, is mounted on the substrate 310. Ink channels (not shown) are subsequently formed in the PZT material, generally parallel with the underlying tracks. Actuation electrodes in these channels are in electrical connection with the respective tracks. A cover plate 320 serves to close the top of the ink channels with orifices 322 in the cover plate functioning as ink ejection orifices.

FIGS. 4(*a*) to 4(*g*) depict in a series of process steps, a method according to a first embodiment of this invention of forming a print head such as that shown in FIG. 3.

A rigid substrate 32 is provided upon which parallel tracks 16 are formed by any conventional method. The tracks connect to a drive circuit (not shown) and can be probed in order to pre-test the connection. The substrate is formed of alumina, a material having a coefficient of thermal expansion comparable to that of PZT.

The PZT block 12 of FIG. 4(*b*) is formed as a laminate of two oppositely poled PZT sheets having polarisation directions 17 and 19 respectively. In one surface of the sheet, a series of shallow, parallel grooves 31 are cut, the grooves having a T-shaped cross section. As in FIG. 4(*c*) the grooves are then filled with a curable resin filled with metallic particles, such as silver-loaded epoxy resin. The resin is cured to the "B" stage. The sheet is then surface skimmed or lapped to leave a series of conductive plugs 30 which, with the sheet 12, form a flat surface 33.

The substrate with the tracks and the piezoelectric material are then brought into contact as depicted in FIG. 4(*d*). The filled grooves 31 and the tracks 16 are at the same spacing and electrically connections are thereby established between them. The silver loaded epoxy resin then undergoes a final curing stage This may itself provide sufficient bonding strength between the substrate 32 and the piezoelectric material 12, but it may be desirable to use an additional securing method such as non-conductive adhesive positioned between the substrate and the piezoelectric material, away from the tracks. Additionally or alternatively, a mechanical clamping arrangement can be provided.

A layer 34 of a lift-off barrier material, such as a wax, is applied to the surface of the sheet 12 opposite to the flat surface 33. The wax material may also cover tracks extending beyond the piezoelectric material and over the drive chips to act as a protective barrier.

As shown in 4(*e*), the next step is to form channels 11 divided by actuator walls 13 by the known technique of sawing. The channels are formed at the same spacing as the plugs 30, and the channels are cut to such a depth that the surfaces 35 of the plugs remote from the substrate layer 32 are exposed. A layer 34 of lift-off material remains on the top of each wall 13.

FIG. 4(*f*) shows that a continuous layer 20 of metal is applied over the remaining layer 34 of lift-off material and on the sides and bottom of each channel. Any one of the techniques of vapour deposition, electroplating or electroless deposition may for example be used. In this embodiment the method used was electroless deposition. The lift-off material 34 and the metal layer 20 over it are removed e.g. by washing, and, as shown in FIG. 4(*g*), the remaining metal layer forms electrodes 24, 25 on opposite walls and on the bottom of the channels 11. It may be desirable to leave the chips and tracks on the substrate coated with the protective layer of lift-off material.

FIG. 4(*h*) is a side view before the sawing step. The lift-off coating 34 is shown on the top surface, and beads of wax 38 are also dispensed to protect the ends. The thickness of the plug 30 is shown, and the chevron bond between the oppositely poled parts of the sheet 12 is indicated at 37. The conducting tracks 16 on the substrate sheet 32 extend beyond the edge of the piezoelectric sheet, for connection to electrical chips or other components.

FIG. 4(*h*) also shows a plating mask 36 used when vapour deposition is used to form the electrodes 24,25. The mask prevents the deposition of metal on the part of the track 16 which is not protected by wax 34.

As an alternative, the grooves 31 can be filled with a solder material, surface-skimmed, and placed in electrical connection with the tracks 16 on the substrate 32 which are made of a solder-compatible material using conventional thin film techniques or by using the known zincate process to provide solder-wettable regions.

FIGS. 5(*a*) to 5(*e*) depict a method of manufacture according to a second embodiment. A sheet 12 of piezoelectric material is chevron-poled and a number of shallow parallel grooves 41 are cut in one surface. In this embodiment the grooves are rectangular in cross section. FIG. 6*a* shows that aluminium, or another appropriate metal is applied to the surface and to the grooves by the process of diffusion bonding. The aluminium forms layers 40, 42 on the sides and bottom of the grooves, and layer 43 on the surface of the plate 12. In FIG. 6(*b*), isolation cuts 44 are made between the grooves 41, through the aluminium layer 43, thereby isolating the layers 41, 42 in each groove 41 from the aluminium layers in adjacent grooves.

In FIG. 5(*c*), a substrate layer 32 with a plurality of parallel tracks 46 is put in position with the width of the tracks 46 spanning the remaining aluminium layer 43 on either side of a groove 41, and the isolation cuts 44 that lie adjacent to the insulating areas of the substrate 32 between tracks 46. The layer 32 and plate 12 are held in relative positions by a suitable clamping arrangement and are placed in a vacuum chamber at elevated temperature to allow diffusion bonding between the aluminium layer 41 and the aluminium track 46. This diffusion bonding then provides both the desired electrical connection and physical bonding of the piezoelectric material to the substrate.

In FIG. 5(*e*), channels 11 are formed by sawing, at spacing equal to the spacing of the grooves 41, and of such depth as to remove the aluminium layers 42 on the bottom of each groove 41. As shown in FIG. 5(*d*), the sides of each channel 11 are covered by electrodes 47 by a conventional plating process to such a depth within the channel that the layers 47 overlap the layers 40. A lift-off layer is used as in the previously described embodiments.

Electrical actuating pulses can therefore be applied to the actuating wall 13 via the aluminium strips 46, the aluminium layers 40, and the electrodes 47.

The manufacturing steps according to a third embodiment of the invention are illustrated in FIGS. 6(*a*) to 6(*e*). In FIG. 6(*a*), a laminate 60 comprises two sheets 62, 64 of piezoelectric material poled in opposite directions as indicated by the arrows. A first array of parallel grooves 66 are formed through the face 68 of sheet 62 and extending into sheet 64. As in the embodiments of FIG. 5, a layer of metal 70, such as copper, is applied by an appropriate known technique. Each metallised channel is filled with a settable filler 72, such as a ceramic-filled epoxy. The filler in each channel 66 results in the laminate being of a considerably less fragile nature than in the prior art, so that handling is easier during subsequent processing steps.

Excess filler is then cleaned from the bottom face of sheet 68 so that the edges of the metal layers 70 on each channel are exposed. A bump 74 of gold is deposited along the exposed edge of metallisation 70 on each channel by a liquid deposition method such as electrolytic plating. In this specification the term "bump" indicates a raised electrically conductive point such as metal area and which is used to form an electrical connection.

At this stage in the manufacturing process it is possible to make temporary electrical connections between a pair of bumps 74 on each channel, and test equipment (not shown). The integrity of the metallisation on the channel walls and base can be tested channel-by-channel. Capacitance measurements can useful provide useful test data on the poled PZT. This is important in allowing faulty metallised PZT sheets to be rejected at a relatively early stage in the manufacturing process.

FIG. 6(*b*) illustrates a substrate layer 80 carrying an array of parallel conducting tracks 82 at the same spacing as the channels 66 in the first array, each track 82 being wider than each channel 66 so as to span the gold bumps 74 at the edges of the metal layers 70 on opposite walls of the channels 66 The tracks 82 may be solder tracks.

The substrate layer 80 also carries drive chips and control chips (not shown), or single chips providing both functions. These chips may be connected in a wide variety of ways, for example by the technique known as "flip chip". Any other necessary processing, which may involve high temperatures which would be detrimental to poled PZT, maybe applied. The substrate layer and the electrical components which it carries can then be tested electrically, before connection to the PZT material.

Electrical connections between each conducting track and the gold bumps 74 are made by techniques such as direct pressure using a glue, or by soldering.

In FIG. 6(*c*) a second array of channels 76 is formed in the face of the sheet 64; each channel 76 in the second array is narrower than each channel 76 in the first array, and the arrays are in register. The channels 76 are of such depth that a layer of filler 78 forms the base of each channel.

The top surface of the piezoelectric material may be lapped to such a depth that conductive material exposed to the ejection channel is removed as shown in FIG. 6(*d*). This results in a print head construction where the electrodes are isolated from fluid contained within the ejection chamber by a thick layer of passivant. Careful choice of the non-conductive material can improve the ejection characteristics of the print head.

It will be apparent that during the majority of steps of the manufacturing process, the channels 66 in the PZT sheets 62, 64 are filled by the filler, so the component is more robust and handling is easier than In comparison with prior art manufacturing processes.

As shown in FIG. 6(*e*), a cover plate 90 is attached to the top surface of the PZT sheets to close the ink channels 66. A generally L-shaped ink supply manifold 92 is contained within the cover plate. A nozzle plate 94 suitably bonded to the end face of the PZT sheets provides ink ejection nozzles 96.

It is apparent from the transverse section provided in this figure, that the circular saw used to form the channels 66 can conveniently leave an arcuate run-off region 98. This region then provides an ink conduit between the supply manifold 92 and the active region of the respective channels.

There is also shown in FIG. 6(*e*), the control or drive chip 100.

In the above described embodiments, the PZT material is positioned over an array of parallel tracks, with channels being subsequently formed in the PZT to provide ejection chambers which overlie the respective tracks. It should be understood that the track need not in all embodiments extend the full length of an ejection chamber, Also, arrangements can be contemplated in which the tracks are not parallel with the ejection chambers.

Thus, as shown diagrammatically in FIG. 7, tracks 702 on a substrate 704 extend orthogonally to ink channels 706 formed in a PZT block 708. FIG. 8 shows on a reduced scale how the tracks 702 serve as connections to an integrated circuit 710 also carried on the substrate. The outline of the PZT block 708 is shown in dotted outline in FIG. 8.

The connecting plugs or contact layers which in previous embodiments have been described as extending the length of the respective channels are replaced in this arrangement by point-like connecting plugs 712. These plugs are formed by drilling into the bottom surface of the PZT material and depositing conductive material. The plugs 712 are positioned, as shown in FIG. 8, so as to interconnect each channel electrode with and only with the corresponding track 702. If necessary, the bottom surface of the PZT material can be coated withy insulating material before formation of the plugs 712, so as to avoid cross coupling of tracks and channel electrodes.

The present invention has been explained with reference to the accompanying figures but is not of course restricted to such embodiments. Features described in a particular combination in the various embodiments may also be combined usefully in different combinations. This disclosure should be regarded as extending to all such combinations. A wide variety of further modifications are possible without departing from the scope of claim. Thus, whilst chevron-like deflection of both chamber walls has been described as a technique for ink droplet ejection, alternative techniques disclosed for example in the quoted references, may readily be employed. In so-called "roof-shooter" constructions, a cover plate provided on the top surface of the piezoelectric material provides ink jet nozzles, either directly or via a separate nozzle plate. Appropriate ink supply manifolds are then provided at or near one or both ends of the chambers. In an "end shooter" arrangement, the cover plate may be plain or may contain an ink supply manifold. This may supply ink from a common source to all chambers or may provide for the supply of—for example—different colour inks to respective sets of ink chambers. A nozzle plate would typically be attached at one end of the chambers, with the other end of the chambers being closed or communication with an ink manifold.

Whilst the use of an alumina substrate has the advantage of thermal characteristics matching PZT, other substrate materials may be employed. In certain applications, a flexible substrate can offer important advantages.

The example of an ink jet printhead has been used to explain this invention. It will be understood that the same or similar techniques can be employed with other forms of droplet deposition apparatus.

All documents, particularly patent applications, referred to are incorporated in the present application by reference.

The invention claimed is:

1. Method of forming a droplet deposition apparatus comprising the steps: forming a substrate having one or more electrically conductive tracks, forming a body of piezoelectric material having a top surface and a bottom surface, providing one or more electrically conductive points on the bottom surface of said piezoelectric material comprising forming one or more depressions in said bottom surface of said piezoelectric material, locating a coating of conductive material in said depressions and further comprising subsequently filling said one or more depressions with a non-conductive material; attaching said body of piezoelectric material to said substrate with said bottom surface overlying said tracks and said electrically conductive points establishing electrical connection with said tracks for actuation of the piezoelectric material, and subsequently forming in said attached piezoelectric material at least on droplet ejection chamber.

2. Droplet deposition component comprising a substrate having one or more electrically conductive tracks thereon; a body of piezoelectric material attached thereto having a top surface and a bottom surface; a plurality of first channels extending into said piezoelectric material from said bottom surface each containing electrically conductive material and a plurality of second channels extending from said top surface into respective first channels and defining open topped ejection chambers; wherein said electrically conductive tracks extend under the bottom surface of said piezoelectric material to establish connection with said electrically conductive material and enable the application of electrical fields to regions of piezoelectric material between said first channels.

3. A component according to claim 2, wherein each first channel is filled with a filler.

4. A component according to claim 3, wherein said filler is conductive.

5. A component according to claim 3, wherein said filler is non-conductive.

6. A component according to claim 5, wherein said open topped ejection chambers extend into said non-conductive material.

7. A component according to claim 6, wherein the conductive material in the first channel is isolated from the associated ejection chamber by the non-conductive material.

8. A component according to claim 2, wherein each first channel has a layer of conductive material.

9. A component according to claim 2, wherein at least one electrically conductive point projects from said bottom surface of said piezoelectric material.

10. A component according to claim 9, wherein said electrically conductive point is a gold bump.

11. A component according to claim 2, wherein said piezoelectric material and said substrate are mechanically and electrically joined by a single material.

12. A component according to claim 11, wherein said single material is a solder.

13. A component according to claim 2, wherein each first channel is a saw cut.

14. A component according to claim 2, wherein said plurality of second channels extend into said piezoelectric component to a depth such that a corresponding one of said first channels is intersected.

15. A component according to claim 2, wherein said open topped ejection chambers are narrower than said first channels.

16. A component according to claim 2, wherein the piezoelectric material is PZT.

17. A component according to claim 2, further comprising a nozzle plate closing the open topped ejection chambers.

18. A component according to claim 2, further comprising a cover plate closing the open topped ejection chambers.

19. Method of forming a droplet deposition apparatus comprising the steps of: forming a body of piezoelectric material having a top surface and a bottom surface; forming a plurality of first channels in said bottom surface, providing electrically conductive material in each channel for use in applying an electrical field across regions of piezoelectric material lying between adjacent first channels; forming a plurality of second channels in said top surface, the second channels being in register with said first channels and forming droplet ejection chambers, with each said second channel extending into a corresponding first channel.

20. Method according to claim 19, further comprising the steps of: forming a substrate having one or more electrically conductive tracks, attaching said body of piezoelectric material to said substrate with said electrically conductive material establishing electrical connection with said tracks for actuation of the piezoelectric material.

21. Method according to claim 20, comprising attaching the body of piezoelectric material to the substrate after forming said first channels and before the formation of said second channels.

22. Method according to claim 19, wherein the step of providing electrically conductive material in each channel comprises depositing a layer of electrically conductive material in the channel.

23. Method according to claim 22, wherein said layer serves as an electrode in applying an electrical field across regions of piezoelectric material lying between adjacent first channels.

24. Method according to claim 22, comprising the further step of filling each first channel with a non-conductive filler after depositing said layer of electrically conductive material.

25. Method according to claim 24, wherein said second channels extend into the filler in the associated first channel.

26. Method of forming a droplet deposition apparatus comprising the steps of: forming a body of piezoelectric material, forming a plurality of first channels in said body of piezoelectric material, depositing a layer of electrically conductive material in each channel to form electrodes capable of applying an electrical field across regions of piezoelectric material lying between adjacent first channels; filling each first channel with a filler; forming a plurality of second channels in said body of piezoelectric material, the second channels being in register with said first channels and narrower than said first channels, with each said second channel extending through the filler of a corresponding first channel to form a droplet ejection chamber in which droplet liquid is isolated from the electrode material by filler.

27. Method according to claim 26, further comprising the steps of: forming a substrate having one or more electrically conductive tracks, attaching said body of piezoelectric material to said substrate with said electrically conductive layer establishing electrical connection with said tracks for actuation of the piezoelectric material.

28. Method according to claim 27, comprising attaching the body of piezoelectric material to the substrate after forming said first channels and before forming said second channels.

29. Droplet deposition component comprising a body of piezoelectric material, a plurality of first channels in said body of piezoelectric material, a layer of electrically conductive material in each channel to form electrodes capable of applying an electrical field across regions of piezoelectric material lying between adjacent first channels; filler material in each first channel; a plurality of second channels in said body of piezoelectric material, the second channels being in register with said first channels and narrower than said first channels, with each said second channel extending through the filler of a corresponding first channel to form a droplet ejection chamber in which droplet liquid is isolated from the electrode material by filler.

30. Droplet deposition component according to claim 29, wherein each second channel comprises a saw cut through the filler of the corresponding first channel.

31. Droplet deposition component according to claim 29, further comprising a substrate having one or more electrically conductive tracks, attached to said body of piezoelectric material with said electrically conductive layer establishing electrical connection with said tracks for actuation of the piezoelectric material.

* * * * *